US007411350B2

(12) United States Patent
Iida et al.

(10) Patent No.: US 7,411,350 B2
(45) Date of Patent: Aug. 12, 2008

(54) SMALL ARC TUBE, LOW-PRESSURE MERCURY LAMP, LIGHTING APPARATUS, MANDREL FOR FORMING THE ARC TUBE, AND PRODUCTION METHOD OF THE ARC TUBE

(75) Inventors: Shiro Iida, Kyoto (JP); Noriyuki Uchida, Hirakata (JP); Tatsuhiro Yabuki, Takatsuki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 139 days.

(21) Appl. No.: 10/918,302

(22) Filed: Aug. 13, 2004

(65) Prior Publication Data

US 2005/0077829 A1 Apr. 14, 2005

(30) Foreign Application Priority Data

Sep. 2, 2003 (JP) ..... 2003-310788

(51) Int. Cl.
*H01J 17/16* (2006.01)
*H01J 61/30* (2006.01)
*H01J 61/20* (2006.01)
*H01J 61/35* (2006.01)

(52) U.S. Cl. ..... 313/634; 313/635; 313/567; 313/639

(58) Field of Classification Search ..... 313/634
See application file for complete search history.

(56) References Cited

U.S. PATENT DOCUMENTS 2,473,878 A * 6/1949 Greiner ..... 362/216
3,558,963 A * 1/1971 Hanneman et al. ..... 313/571
6,545,430 B2 * 4/2003 Ono et al. ..... 315/291
6,630,780 B1 * 10/2003 Yan ..... 313/634
D488,874 S * 4/2004 Li ..... D26/3
D503,814 S * 4/2005 Iida ..... D26/3
D503,987 S * 4/2005 Iida ..... D26/3
2003/0234614 A1 * 12/2003 Itaya et al. ..... 313/634
2006/0197451 A1 * 9/2006 Iwase ..... 313/634

FOREIGN PATENT DOCUMENTS

CN 2534674 Y 2/2003

* cited by examiner

*Primary Examiner*—Sikha Roy
*Assistant Examiner*—Natalie K Walford

(57) ABSTRACT

A mandrel has a main body having a substantially-cone-shape. The main body has, on its circumferential surface, a spiral-shaped groove at which the glass tube to be wound is held. The groove, in cross section, has a contact range in which the glass tube's circumferential surface is in contact. One end of the contact range corresponds to a circumference part of the glass tube in wound state which is closest to the axis of the main body of the mandrel, a part of the groove that extends from the circumference part towards the apex of the main body is parallel to the axis of the mandrel, and the pitch of the groove in the axial direction of the mandrel is formed smaller than the outer diameter of the glass tube. The glass tube wound on the mandrel is easily removed from the main body by lowering the mandrel. In the arc tube formed in such a way, any two glass tube portions, which are adjacent to each other in the axial direction of the arc tube, overlap with each other.

12 Claims, 12 Drawing Sheets

DISTRIBUTION CHARACTERISTICS OF LUMINOUS INTENSITY
(VERTICAL CROSS SECTION)

SMALL ARC TUBE, LOW-PRESSURE MERCURY LAMP, LIGHTING APPARATUS, MANDREL FOR FORMING THE ARC TUBE, AND PRODUCTION METHOD OF THE ARC TUBE

This application is based on application No. 2003-310788 filed in Japan, the contents of which are hereby incorporated by reference.

BACKGROUND OF THE INVENTION (1) Field of the Invention

The present invention relates to an arc tube formed in a spiral that broadens out from the middle part towards the end-side, a low-pressure mercury lamp, a lighting apparatus, a mandrel, and to a production method of such an arc tube.

(2) Related Art

Conventionally, there are fluorescent lamps for general lighting purpose that use a circular arc tube (hereinafter, this type of fluorescent lamp is referred to as "circular fluorescent lamp"). The majority of such circular fluorescent lamps have a rated lamp wattage of 18 w to 40 w, and their usage is varied.

Recently, there are strong demands for making smaller circular fluorescent lamps. This is because if a circular fluorescent lamp is made smaller, the lighting apparatus to which the fluorescent lamp is to be fixed can also be made smaller.

One kind of arc tube smaller than conventional circular arc tube is disclosed in the specifications of West German Patent No. 871927, and of West German Patent No. 860675. The disclosed arc tube is formed by winding a glass tube from its center to the both ends around the axis of spiral (hereinafter, "spiral axis"), into a double-spiral configuration that broadens out from the center to the both ends.

Specifically, a body of the double-spiral arc tube is formed by winding a glass tube in softened state on double-spiral grooves cut on a circumferential surface of a mandrel having a substantially circular-cone shape(hereinafter, "glass tube in softened state" is referred to as "softened glass tube" in this specification). The grooves at the circumferential surface of the mandrel are cut to be concave in a direction orthogonal to the axis of the mandrel, and towards the axis. Furthermore the grooves are formed to be concave in a semicircular shape so as to be in contact with half of the circumference of the glass tube. Note that the arc-tube body formed in double-spiral configuration using this mandrel will be shaped so that its glass tube is wound around the axis of the mandrel, and this axis will be the spiral axis for the arc-tube body and of the arc tube.

The pitch of the grooves in the direction into which the axis of the mandrel extends (this direction is called "height direction") is larger than the outer diameter of the glass tube wound on the mandrel. Therefore, there is a problem that, when the arc-tube body is viewed in the direction orthogonal to the spiral axis, space exists between adjacent glass tubes in the direction into which the spiral axis extends (this direction is also called "height direction").

To be more specific, a conventional circular fluorescent lamp is usually fixed to a lighting apparatus having been fixed to the ceiling and the like, and so it is preferably thin. As opposed to this, the arc tube formed using the aforementioned mandrel has large height (i.e. thickness), although being able to have smaller outer diameter than conventional arc tubes used for circular fluorescent lamps. This makes it difficult to make such an arc tube to replace the conventional circular fluorescent lamp.

In addition, suppose that the glass tube's cross section is divided into two by a height-direction line passing through the center of the cross section. Then the cross-section of the grooves of the mandrel has such a shape as to be in contact with a half of the circumference of the glass tube cross-section that is positioned closer to the axis of the mandrel. Accordingly, when taking the wound glass tube out from the mandrel, it is necessary to rotate either the mandrel or the wound glass tube in the reverse direction to the direction of rotation adopted at the time of winding the glass tube. This makes the production of the arc-tube body troublesome, as well as necessitating a complicated production apparatus that includes a driving apparatus for rotating such mandrel or glass tube.

SUMMARY OF THE INVENTION

The present invention, having been conceived in light of the aforementioned problems, has the first object of providing an arc tube whose outer diameter is made smaller than that of a conventional circular fluorescent lamp and whose size in the direction to which the spiral axis extends is as small as that of the circular fluorescent lamp, and of providing a low-pressure mercury lamp made smaller than the conventional circular fluorescent lamp. The second object of the present invention is to provide a lighting apparatus whose overall size is made small. Furthermore the third object of the present invention is to provide a mandrel for forming such an small arc tube. Finally, the fourth object of the present invention is to provide a production method by which such a small arc tube is produced.

So as to achieve the first object stated above, the arc tube according to the present invention has: an arc-tube body made of a glass tube that is wound around an axis from a middle part towards at least one of ends, to form a spiral broadening out from the middle part towards the end in the axial direction; and electrodes respectively sealed to the ends of the arc-tube body, where a gap exists between any two glass tube portions adjacent to each other in a direction orthogonal to the axis when the arc-tube body is viewed in the axial direction, and any two glass tube portions adjacent in the axial direction overlap with each other when the arc-tube body is viewed in the direction orthogonal to the axis.

Note that "when the arc-tube body is viewed in the axial direction" means that the arc-tube body is viewed so that the line of sight coincides with the axial direction. Likewise, "when the arc-tube body is viewed in the direction orthogonal to the axis" means that the arc-tube body is viewed so that the line of sight coincides with the direction orthogonal to the axis. This also applies to any similar expressions used in the present specification.

With the stated structure, two glass tube portions adjacent to each other in the axial direction overlap with each other, in a state that, when viewed in the direction orthogonal to the axis, one of the two glass tube portions that is nearer to the end is positioned outside the other glass tube portion. Therefore the arc tube is able to be made smaller in the axial direction. Accordingly, if the overlapping amount is made larger, it becomes possible to have an arc tube whose height can be compared to the height of an arc tube conventionally used for the circular fluorescent lamps.

Furthermore, so as to also achieve the first object, the low-pressure mercury lamp according to the present invention has the arc tube with an overlapping amount. With the stated structure, a resulting arc tube will have small height, and so the low-pressure mercury lamp will be accordingly made small.

Furthermore, so as to achieve the second object stated above, the lighting apparatus according to the present invention is a low-pressure mercury lamp. With the stated structure, a resulting low-pressure mercury lamp will have small height, and so the lighting apparatus will be accordingly made small.

So as to achieve the third object stated above, the mandrel according to the present invention has a cone-shaped main body, and is used for winding, on the main body, a softened glass tube from a middle part towards at least one of ends, so as to form an arc-tube body as a spiral that broadens out from the middle part towards the end in an axial direction of the main body of the mandrel, where the main body is provided with a groove at which the glass tube to be wound is held, and the groove, in any cross section, is in contact with the glass tube in wound state, at least at a circumference point of the glass tube in wound state which is closest to the mandrel's axis, a part of the groove that extends from the circumference point towards an apex of the main body is either parallel to or is inclined toward the axis, and a pitch of the groove in the axial direction is smaller than an outer diameter of the glass tube. Here, "cone-shape" includes a cone whose bottom is oval-shaped (including circular shape), and also includes a cone whose bottom is polygonal-shaped. In addition, "groove" used here is for holding the glass tube wound on the main body, and so its shape is not limited to a particular shape. For example, the cross section of the groove (the cross section being when cut along the direction orthogonal to the elongating direction of the groove) may be right-angular shape, or arc shape. Needless to say, the cross section of the groove may also be a deformed version of these shapes. In the mandrel having the stated structure, the pitch of the groove in the mandrel's axial direction is smaller than the outer diameter of the glass tube. Therefore in the arc-tube body created by being wound on the mandrel, any two glass tube portions adjacent in the axial direction overlap with each other when the arc-tube body is viewed in the direction orthogonal to the axis. Therefore the arc tube is able to be made smaller in the axial direction. Furthermore, the groove, in any cross section, is in contact with the glass tube in wound state, at least at a circumference point of the glass tube in wound state which is closest to the mandrel's axis, a part of the groove that extends from the circumference point towards an apex of the main body is either parallel to or is inclined toward the axis. Therefore, the glass tube wound on the mandrel can be easily removed from the mandrel, only by separating them in the axial direction of the mandrel.

So as to achieve the fourth object stated above, the production method according to the present invention is for producing an arc tube made of a glass tube that is wound around an axis from a middle part towards at least one of ends, to form a spiral broadening out from the middle part towards the end in the axial direction, the production method having: a winding step of winding a softened glass tube to the groove of the mandrel; and a separating step of separating the wound glass tube from the mandrel, in a direction in which an axis of the mandrel extends. In the stated production method, the above-described mandrel is used Therefore, the arc tube is able to be made small in the axial direction. In addition, the removing of the wound glass tube from the mandrel is performed by separating them in the axial direction. According to this, the removing of the glass tube becomes easy and is performed in a short time. In addition, it becomes possible to simplify the structure of the production apparatus since, in order to remove the glass tube from the mandrel, it is no more necessary to rotate either the glass tube or the mandrel in the reverse direction to the direction of rotation adopted at the time of winding the glass tube.

BRIEF DESCRIPTION OF THE DRAWINGS

These and other objects, advantages and features of the invention will become apparent from the following description thereof taken in conjunction with the accompanying drawings that illustrate a specific embodiment of the invention. In the drawings.

DESCRIPTION OF THE PREFERRED EMBODIMENTS

Figure 1:
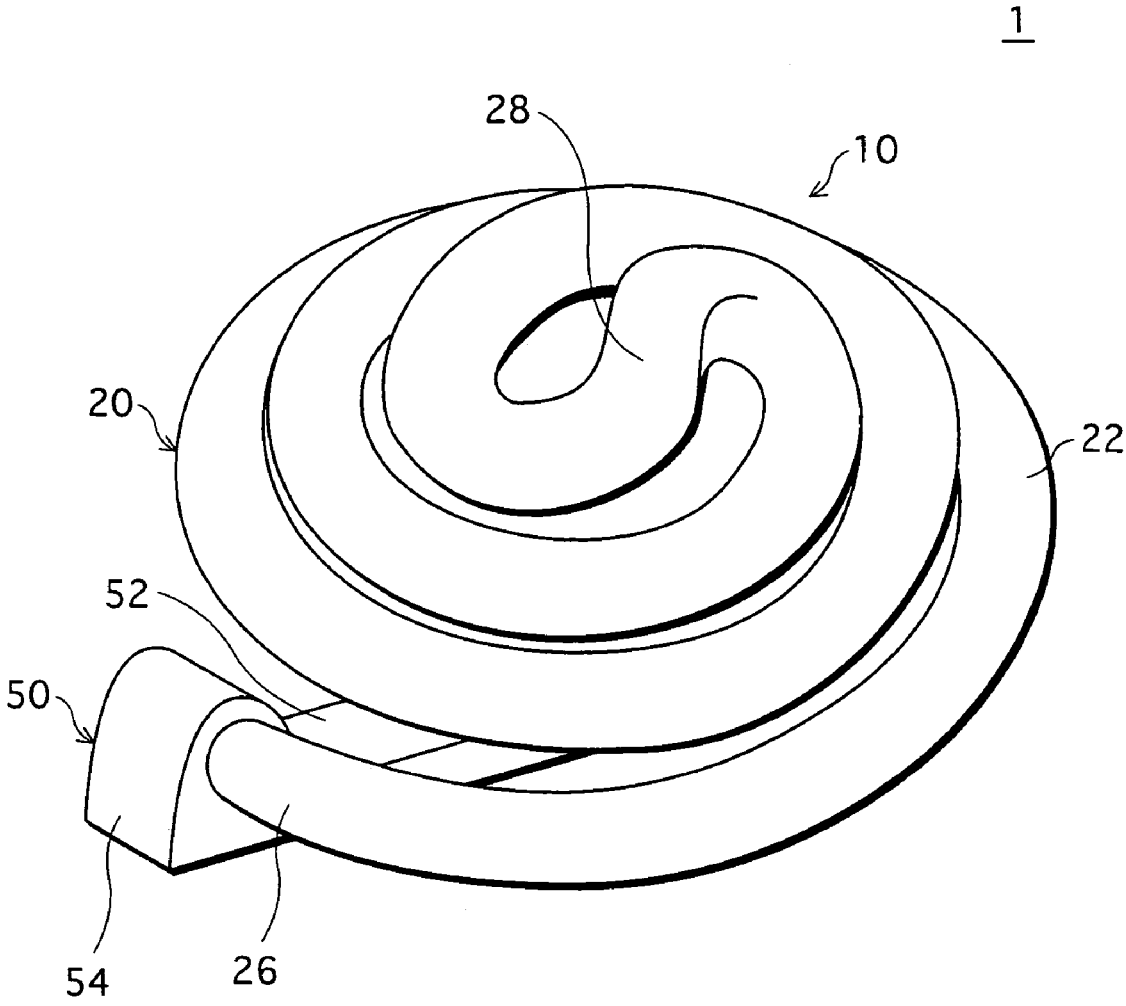
FIG. 1 is a perspective view of a fluorescent lamp according to the present invention.

The following describes an embodiment in which the present invention is applied to a fluorescent lamp, being one kind of the low-pressure mercury lamp, by referring to the drawings.

1. Structure of Fluorescent Lamp

Figure 2:
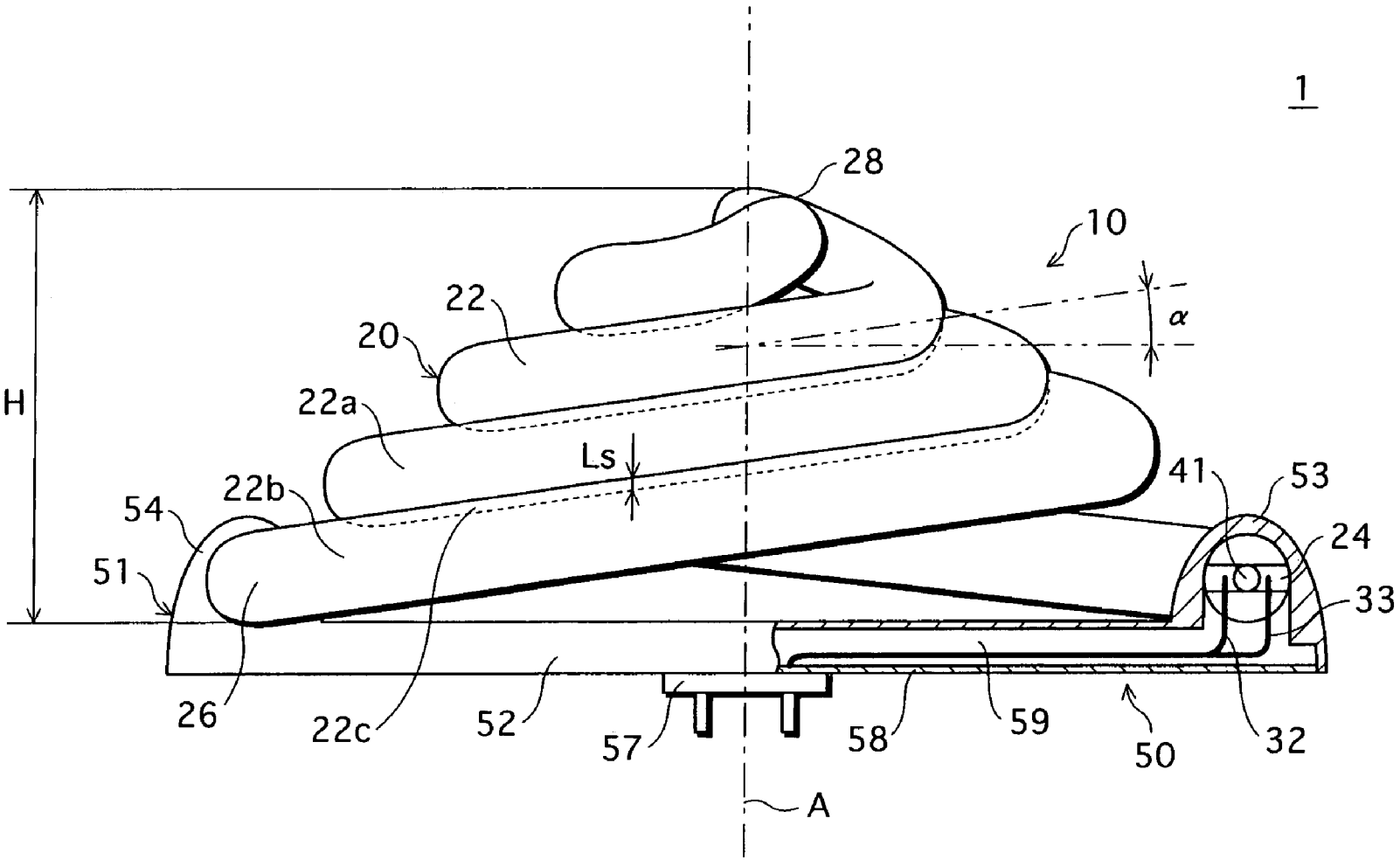
FIG. 2 is a side view of the fluorescent lamp, when viewed in the direction orthogonal to the spiral axis of the arc tube, where a part of the fluorescent lamp is cut away so as to show the internal state of its holder.
Figure 3:
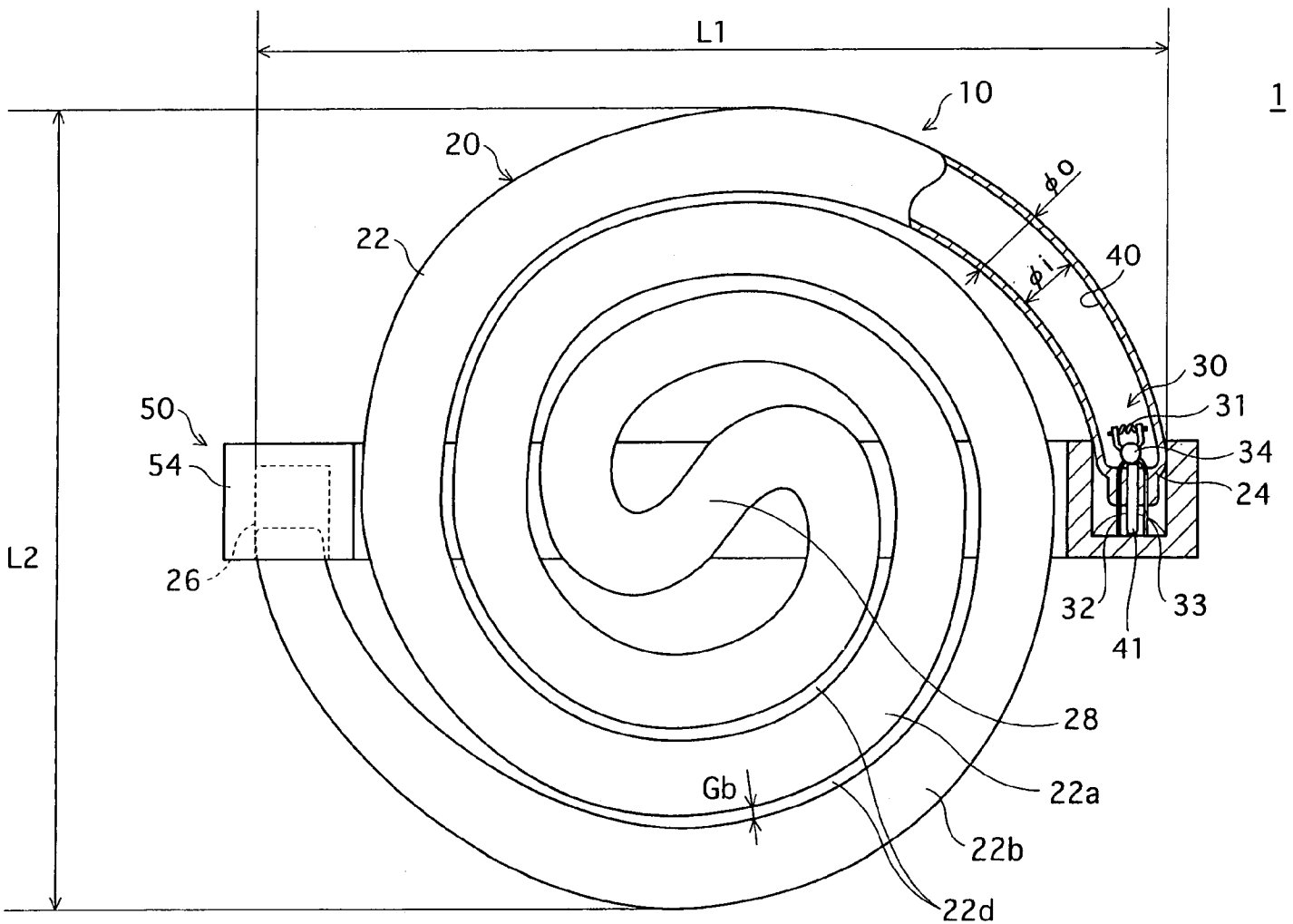
FIG. 3 is a plan view of the fluorescent lamp, when viewed in a direction in which the spiral axis of the arc tube extends and that from a surface to be irradiated, where a part of the fluorescent lamp is cut away so as to show the internal state of the fluorescent lamp.

FIG. 1 is a perspective view of the fluorescent lamp of this embodiment, and FIG. 2 is a side view thereof, when viewed in the direction orthogonal to the spiral axis of its arc tube, where a part of the fluorescent lamp is cut away so as to show the internal state of its holder. FIG. 3 is a plan view of the fluorescent lamp, when viewed in the axis-of-spiral direction of the arc tube and that from a surface to be irradiated, where a part of the fluorescent lamp is cut away so as to show the internal state of the fluorescent lamp.

This fluorescent lamp 1 is an alternative of a circular fluorescent lamp of 28 w type, and has a rated lamp wattage of 27 w. Note that the sizes of the circular fluorescent lamp of 28 w type are as follows: the outer diameter of the circular configuration of the arc tube is 225 mm, and the outer diameter of each glass tube constituting the arc tube is 29 mm.

This fluorescent lamp 1 is made up of: an arc tube 10 that has one discharge path inside; and a holder 50 for holding this arc tube 10. Note that a base 57 for power supply is fixed to this holder 50, as detailed later.

(1) Arc Tube

As shown in FIGS. 1-3, the arc tube 10 is comprised of: an arc-tube body 20 formed by bending one glass tube 22; and electrodes 30 respectively hermetically-sealed to the both ends 24, 26 of the arc-tube body 20 (refer to FIG. 3). Mercury (e.g. of 5 mg) and buffer gas such as argon gas (e.g. of 400 Pa) are enclosed in the arc-tube body 20.

Note that in FIG. 3, the electrode at the end 26 of the arc-tube body 20 is omitted for convenience of the drawing. However, an electrode having the same structure as the electrode 30 sealed to the end 24 is sealed to the end 26, too.

In addition, the mercury may be enclosed in the arc-tube body 20 in a single form, or in an amalgam form such as zinc mercury, tin mercury, and bismuth/indium mercury.

As shown in FIGS. 2 and 3, the arc-tube body 20 is formed in a double-spiral configuration that is wounded around a spiral axis A with an inclination angle of $\alpha$, and that broadens out from a center part 28, positioned in a substantial center of the glass tube 22, to the ends 24, 26. In other words, the outward appearance of the arc-tube body is a substantially circular-cone shape.

In the above, the direction in which the spiral axis A of the arc-tube body 20 extends is defined to be "height direction". Note that this also applies to the arc tube 10 too; and the direction of the arc tube 10, in which the spiral axis A of the arc-tube body extends, is also called "height direction". In addition, the side at which the center part 28 is positioned in the height direction of the arc-tube body 20 is referred to as "upper side", and the side at which the ends 24 and 26 are positions is referred to as "lower side".

The glass tube 22 is made of strontium-barium silicate glass (soft glass), for example, and whose cross section is substantially circular, as an example. Note that the cross section of the glass tube is not limited to circular, and may also be oval. Note that since the arc-tube body 20 is formed by bending a softened glass tube, the cross sectional shape of the softened glass tube is deformed in some degree.

When this arc-tube body 20 is viewed from the side as shown in FIG. 2, between two adjacent glass tubes, part of the lower glass tube (shown by reference numeral 22*b*) overlaps with the upper glass tube (reference numeral 22*a*). The lengthwise size of this overlapping part 22*c* is expressed as Ls.

In addition, when the arc-tube body 20 is viewed in plan as shown in FIG. 3, a gap 22*d* is formed between two glass tubes 22 adjacent to each other in the direction orthogonal to the spiral axis A (hereinafter "radius direction"). The length of this gap 22*d* in the radius direction is expressed as Gb.

Note that in the present embodiment, this gap is formed larger for the part of the arc-tube body 20 in the vicinity of the ends 24 and 26 (end-vicinity part), than for the part of the arc-tube body 20 from the center part 28 to the end-vicinity part, so as to facilitate fixing of the ends 24 and 26 to the holder 50. Note that what is meant by "gap 22*d*" here is a gap nearer to the center part 28 than to the ends 24, 26.

The internal surface of the arc-tube body 20 is applied with a phosphor 40. This phosphor 40 is produced by mixing three kinds of rare-earth phosphors respectively emitting red ($Y_2O_3$:Eu), green ($LaPO_4$:Ce, Tb), and blue ($BaMg_2Al_{16}O_{27}$: Eu, Mn), for example.

Each electrode 30 adopts a so-called beads glass mounting method, as shown in FIG. 3, and is comprised of: a coil electrode 31 made of tungsten; a pair of lead wires 32, 33 for supporting this coil electrode 31; and a beads glass 34 for fixing and supporting the pair of lead wires 32, 33.

In the electrode 30, the part to be fixed to the ends 24 (, 26) of the arc-tube body 20 is a part corresponding to the lead wires 32, 33 (more specifically, a part that extends in the direction opposite to the coil electrode 31).

Note that after the electrode 30 is sealed to one end of the arc-tube body 20 (the end 24, in this example), an exhaust tube 41 is sealed to the end 24 together with the electrode 30, the exhaust tube 41 being for exhausting air from the arc-tube body 20, and for sealing the buffer gas.

Here, the arc tube 10 is a finished item in which the buffer gas and so on has been sealed therein, after the phosphor 40 has been applied to the inner surface of the arc-tube body 20. Therefore where "arc tube 10" is used in the following description, the ends 24, 26, and the center part 28 of the arc-tube body 20, for example, are used as they are, to describe the corresponding parts of the arc tube 10 (i.e. "ends 24, 26 of the arc tube 10", and "center part 28 of the arc tube 10", and so on). Likewise, the radius direction of the arc-tube body 20 is also used for the corresponding direction of the arc tube 10 (i.e. "radius direction of the arc tube 10").

(2) Holder

Figure 4:
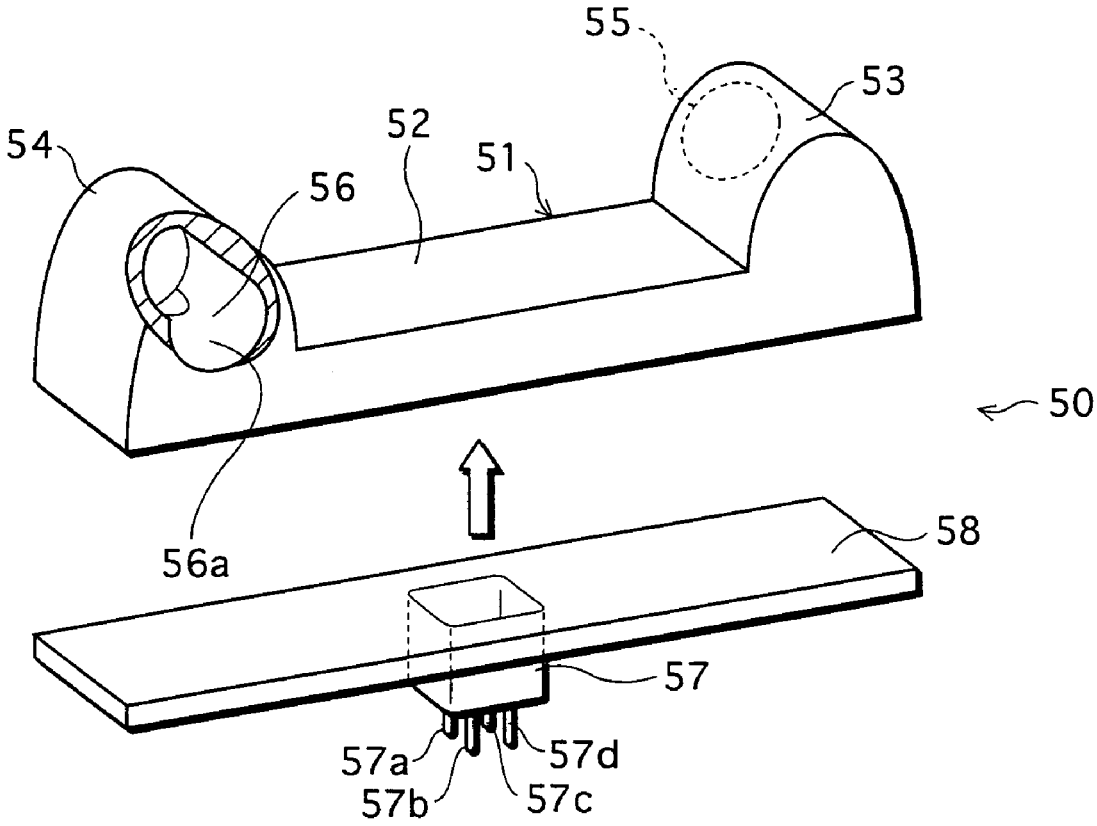
FIG. 4 is a perspective exploded view of the holder, a part of which is cut away so as to show the internal state.

FIG. 4 is a perspective exploded view of the holder, a part of which is cut away so as to show the internal state.

As shown by FIGS. 1-4 (more particularly by FIG. 4), the holder 50 is comprised of a holding member 51 for holding the ends 24, 26 of the arc tube 10, and a base-fixing member 58 to which a base 57 has been fixed, the base 57 being for supplying power to the arc tube 10. Note that the base 57 is a type that is equipped with power-source connection pins 57*a*, 57*b*, 57*c*, and 57*d*.

The holding member 51 is comprised of: a rectangular platform 52 whose lengthwise side extends in the direction connecting the ends 24 and 26 of the arc tube 10; and two protuberance parts 53 and 54 formed at both ends of the lengthwise side of the platform 52. Insertion holes 55 and 56 are formed at these protuberance parts 53 and 54, so that the ends 24 and 26 of the arc tube 10 are inserted thereto.

The insertion holes 55, 56 have a shape corresponding to the shape of the ends 24, 26 of the arc tube 10. Specifically, the insertion holes 55, 56 have respective portions that extend in the widthwise direction of the platform 52 and are provided at the respective end surfaces of the protuberance parts 53, 54 in the widthwise direction of the platform 52 (these portions of the insertion holes are referred to as "first hole-portion"), as well as subsequent portions that curve down towards the backside surface of the platform 52 (these subsequent portions of the insertion holes are referred to as "second hole-portion"). In other words, each of the insertion holes 55, 56 has two hole-portions that constitute "L-shape" combined together.

By this configuration, the ends 24, 26 of the arc tube 10 can be supported by being made abut against the inner surface portions 56*a* of the respective first hole-portions extending in the widthwise direction (the inner surface portion of the insertion hole 55 is not shown in the drawing). Furthermore by this configuration, the lead wires 32, 33, which extend from the ends 24, 26, will be led to the backside surface of the platform 52 via the respective second hole-portions.

As shown in FIG. 2, the inner surface of the holding member 51 is provided with a space 59 through which the pair of lead wires 32, 33 can pass to reach the base 57. The base-fixing member 58 is fitted to the inner surface of the holding member 51, so as to close the space 59 from the lower side.

(3) Lighting Apparatus

Figure 5:
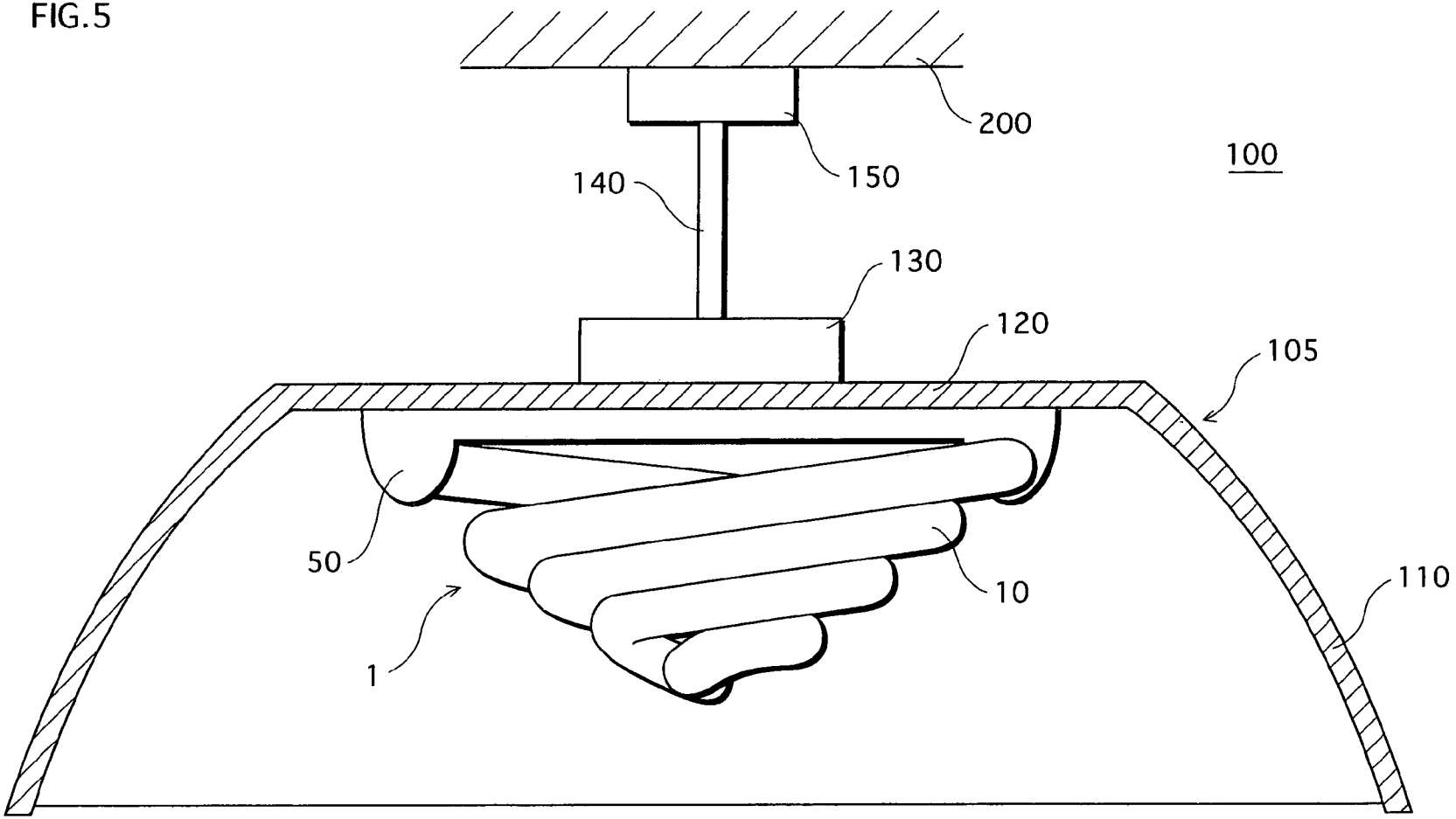
FIG. 5 is a simplified diagram showing a lighting apparatus that employs the lamp according to the present invention, a part of which is cut away so as to show the internal state.

FIG 5 is a simplified diagram showing a lighting apparatus that employs the lamp according to the present invention, a part of which is cut away so as to show the internal state.

A lighting apparatus 100 employs the above-described fluorescent lamp 1.

As shown in this drawing, one example of the lighting apparatus 100 is a pendant type, and is comprised of: an apparatus body 105; a cable 140 for supplying power to the apparatus body 105; and a socket 150 to be fixed to a rosette at the ceiling 200, for example, for hanging the apparatus body 105 through the cable 140.

The apparatus body 105 is made up of: a shade 110 having a flat bottom 120 in the substantial center; a fluorescent lamp 1 removably fixed to a side of the bottom 120 at the inside of the shade; and a lighting circuit member 130 fixed to another side of the bottom 120 at the outside of the shade, so as to store an electronic ballast that lights the fluorescent lamp 1.

When the base 57 (e.g. see FIG. 2) is connected to a socket with the center part 28 of the arc tube 10 oriented downward, the fluorescent lamp 1 is removably fixed to the bottom 120, as well as obtaining electrical connection. In addition, the electronic ballast adopts a series inverter method, and is exclusively for high frequency.

The inner surface of the shade 110 is made to be a reflection surface, for example, and reflects the light emitted from the fluorescent lamp 1 into a desired direction (e.g. into a downward direction to illuminate the lower side). This reflection surface is formed, for example, by applying white paint or alumina particles.

When the fluorescent lamp 1 is lit by the electronic ballast mentioned above, a coldest place is formed in the center part 28. The temperature at this coldest place (so-called "coldest-point temperature") is designed to be the value at which the mercury vapor pressure in the arc tube 10 during lamp's normal lighting yields maximum lamp efficiency. Please note that the reason why the mercury vapor pressure is defined using the coldest-point temperature is because the mercury vapor temperature during lamp's normal lighting is uniquely defined by this coldest-point temperature.

2. Concrete Structure of Fluorescent Lamp

The glass tube 22 used for the arc-tube body 20 has the outer diameter Φo of 9.0 mm, and the inner diameter Φi of 7.4 mm.

In the arc-tube body 20, the number of turns in which the glass tube 22 is wound around the spiral axis A is 3.5 in total, taking into account the both sides of the glass tube 22 respectively from the center part 28 to the ends 24, 26. The height H of the arc tube 10, shown in FIG. 2, is 38 mm. Here, the glass tube 22 is wound with an inclination angle of 4 degrees with respect to the direction orthogonal to the spiral axis A (corresponding to "α" of FIG. 2).

Here, the length LS of the overlapping part 22*c* between the horizontally adjacent glass tubes 22 is 1.5 mm. This length LS corresponds to about 16% of the glass tube (i.e. outer diameter Φo of 9.0 mm). By setting the length LS of the overlapping part 22*c* to be 1.5 mm, the overall height of the arc-tube body 20 will be restrained, so as to be closer to the height of the arc tube conventionally used in the circular fluorescent lamps (which is 29 mm).

In addition, as shown in FIG. 3, the length L1 of the arc tube 10, in the direction connecting the ends 24 and 26, is 100 mm; and the length L2, in the direction orthogonal to the line connecting the ends 24 and 26, is 90 mm. Here, the length Gb of the gap 22*d*, between two glass tubes 22 adjacent to each other in the radius direction of the arc tube 10, is 1.0 mm (the length Gb is specifically a minimum distance between the two adjacent glass tubes 22).

The size of the arc tube 10 in plan view can be said to be about the half as the size of the conventional circular fluorescent lamp (such a conventional circular fluorescent lamp having an outer diameter of 225 mm).

The arc tube 10 having the above-described structure has a between-electrode distance of 600 mm within the discharge path. The lamp input of this arc tube 10 is 27 W, and the bulb wall loading for this arc tube 10 is 0.19 W/cm$^2$. Furthermore when the fluorescent lamp 1 was lit with the lamp input of 27 W, the luminous flux emitted from the fluorescent lamp 1 was 2200 lm, the lamp efficiency was 81.5 W/lm, and the rating life was 11,000 hours. This luminous flux is substantially the same as that of the circular fluorescent lamp of 28 W type (2210 lm). Note that during lighting, the electric current of the arc tube is about 135 mA, and the voltage is 200V.

As described so far, the fluorescent lamp 1 of the present invention has lamp quality comparable to the conventional circular fluorescent lamp, as well as having sufficiently small size.

3. Production Method of Fluorescent Lamp (1) Mandrel Employed to Form Arc-Tube Body The arc-tube body 20, having the above-described structure, is formed by winding a softened glass tube on a mandrel having a substantially circular-cone shape (this being the mandrel of the present invention).

Figure 6:
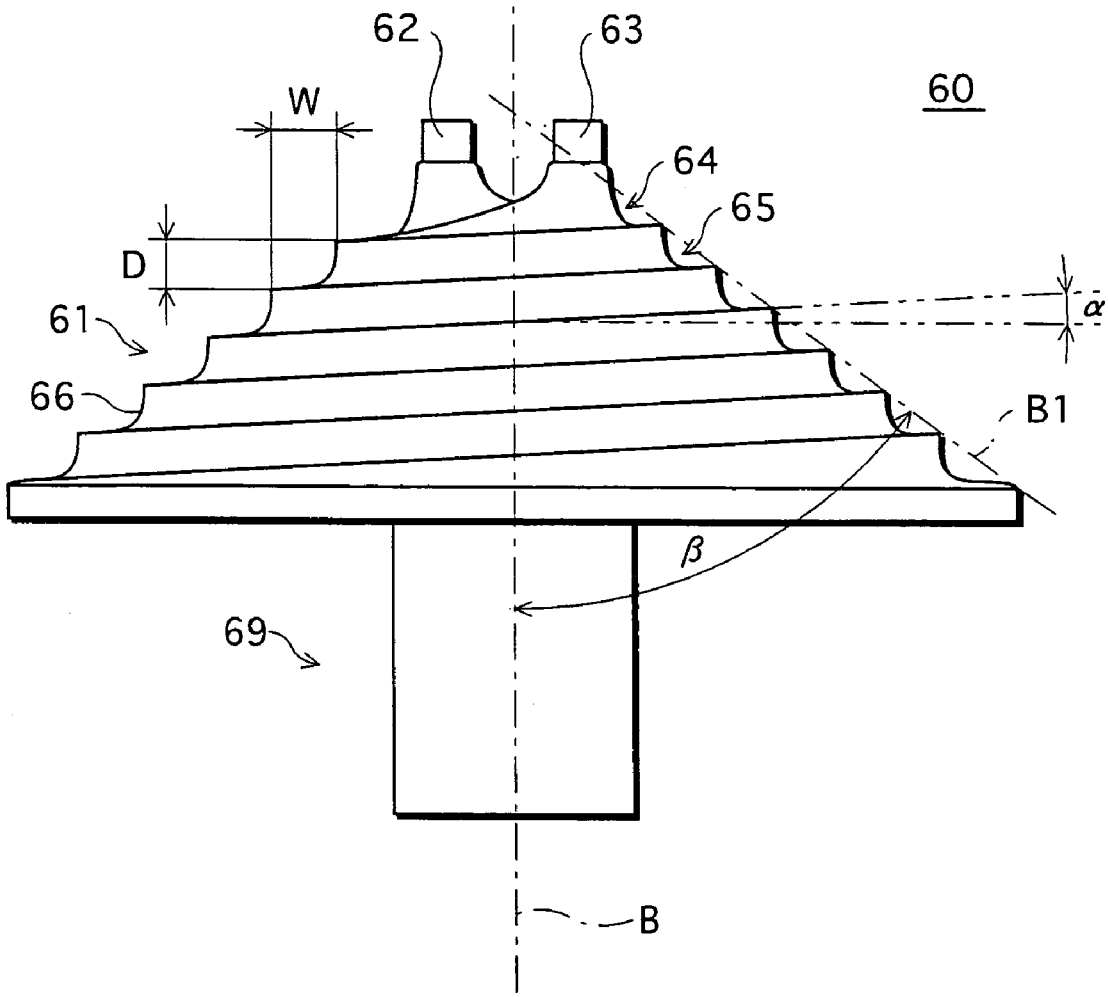
FIG. 6 is a side view of a mandrel when viewed in a direction orthogonal to the axis thereof.
Figure 7:
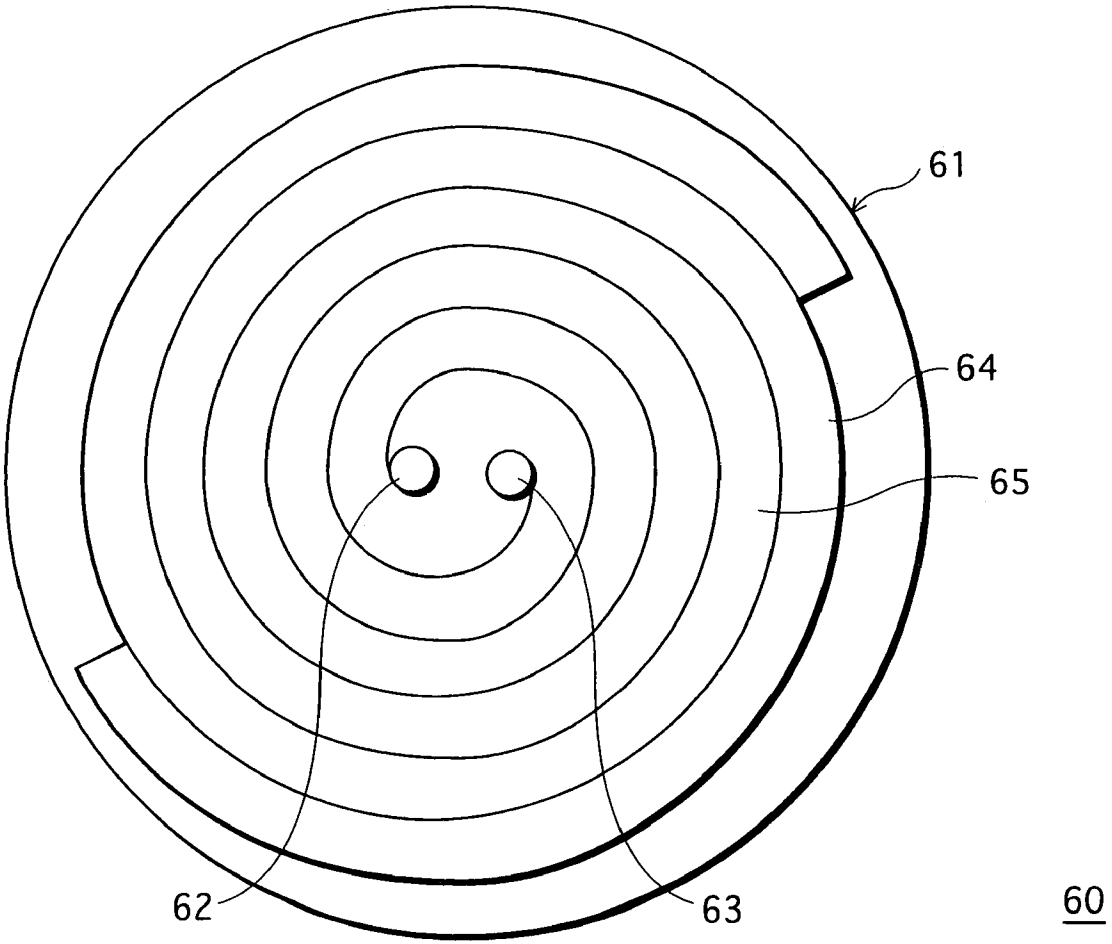
FIG. 7 is a plan view of the mandrel, when viewed in a direction in which the axis extends and that from the top.

FIG. 6 is a side view of the mandrel when viewed in a direction orthogonal to the axis thereof. FIG. 7 is a plan view of the mandrel, when viewed in a direction in which the axis extends and that from the apex. Note that this direction in which the axis of the mandrel 60 extends is also hereinafter referred to as "height direction". In addition, in FIG. 7, the direction which is orthogonal to the axis of the mandrel 60 is referred to as "radius direction".

As shown in FIGS. 6 and 7, the mandrel 60 is made up of: a main body 61 having a substantially circular-cone shape; and a column-shaped fixing part 69 at which the mandrel 60 is fixed to a driving apparatus not shown in the drawings. A glass tube will be wound around the circumferential surface of the main body 61. Note that since the axis of the main body 61 coincides with the axis of the fixing part 69, FIG. 6 collectively shows these axes as the axis of the mandrel 60, which is expressed as a reference sign of "B".

A pair of latching parts 62 and 63 are provided at the apex of the main body 61, and two grooves 64, 65 are formed on a circumferential surface of the main body 61, in spiral configurations that continue from the apex to the bottom of the main body 61. The two grooves 64 and 65 are at which the glass tube is to be held when it is wound around the main body 61.

The pair of latching parts 62 and 63 protrude in the height direction from the apex of the main body 61, while having a space for the glass tube therebetween. More specifically, the latching parts 62 and 63 are constituted by column members such as pins mounted parallel to the axis B of the mandrel 60.

Note that the column members used here have a circular cross section, but can be in any shape as long as at least the part thereof to be in contact with the glass tube is shaped like an arc. Moreover, the column members may be formed to have a narrower top compared to their bottom portion. To be more specific, the column members may have any shape as long as, when taking off the glass tube from the mandrel 60, the glass tube and the mandrel 60 can be detached in the height direction, in other words, the column members have to have a shape that, when for example the mandrel 60 is pulled down, the latching parts 62, 63 will not obstruct the glass tube.

Figure 8:
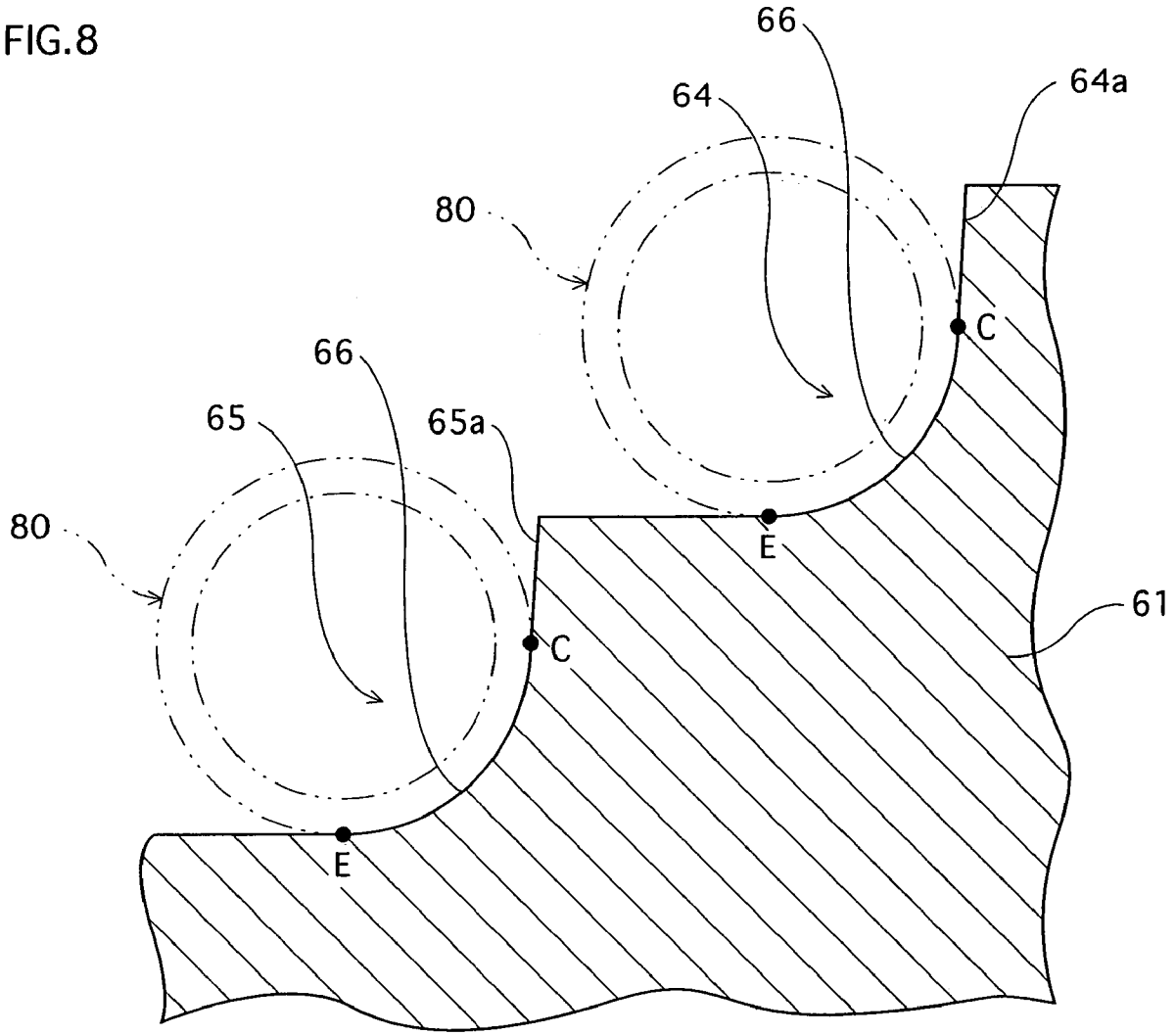
FIG. 8 is an enlarged longitudinal sectional view of the grooves.

FIG. 8 is an enlarged longitudinal sectional view of the grooves.

The grooves 64, 65 are formed along the circumference of the main body 61, and the cross section of the grooves 64, 65 is taken along the direction orthogonal to the elongating direction of the grooves. The cross section of the grooves 64, 65 coincides with a cross section of the main body 61 taken along a plane that includes the axis B of the main body 61.

As shown in FIGS. 6 and 8, the ranges of the cross section of the two grooves 64, 65, with which the glass tube 80 is to be in contact, look like a staircase formed along the edge of the main body 61 in a side view, and the corner part of each of the grooves 64, 65, in cross sectional view, is formed as arc-shaped surface 66 having the same curvature as the circumference of the glass tube 80 (shown as an imaginary circle in FIG. 8).

Here, suppose a cross section of the glass tube 80 is divided into four, by a height-direction line that passes through the center of the cross section and the line that also passes through the center of the cross section and that is orthogonal to the height-direction line. Then, ¼ of the circumference of the glass tube 80 positioned nearest to the bottom and to the axis B will be in contact with the arc-shaped surface 66.

The range in which the glass tube 80 and each of the grooves 64, 65 are in contact (contact range) is substantially equal to the aforementioned arc-shaped surface 66, when both of the glass tube 80 and the grooves 64, 65 are viewed in cross section. As shown in FIG. 8, one end of a contact range is the position C that corresponds with a circumference point of the glass tube 80 in wound state on the main body 61, the circumference point being closest to the axis B of the mandrel 60. The other end of the contact range is the position E that corresponds to another circumference point of the glass tube 80 in wound state on the main body 61, this circumference point being in contact with a line with an inclination angle a with respect to the direction orthogonal to the axis B of the mandrel 60.

In addition, at the contact ranges in the cross sectional view of the grooves 64 and 65, parts 64*a* and 65*a* are formed to be parallel to the axis B of the mandrel 60, where the parts 64*a* , 65*a* are respectively a part positioned nearer to the top than the position C (i.e. upper side with respect to the position C).

Next, the concrete structure of the mandrel 60 is described. This mandrel 60 is for creating the arc-tube body 20 explained above under "2. Concrete structure of fluorescent lamp".

As shown in FIG. 6, a step D for the grooves 64, 65 which are formed as a staircase along the circumference of the main body 61, is about 0.83 time the outer diameter Φo of the glass tube 80 to be wound. In addition, the width W of the grooves 64, 65 is about 1.1 times the outer diameter Φo of the glass tube 80. Note that the angle β between a line B1 connecting the angular-edges of the grooves 64 and 65, which are formed as a staircase, and the axis B is about 53 degrees.

In other words, the height-direction pitch of the grooves 64, 65 is a value resulting from subtracting the length LS of the overlapping part 22*c* from the outer diameter Φo of the glass tube 80. On the other hand, the pitch of the grooves 64, 65 in the radius direction of the mandrel 60 (hereinafter simply "radius-direction pitch of the grooves 64, 65") is resulting from adding the length Gb of the gap 22*d* of the glass tubes 22 of the arc tube 10 adjacent to each other in the radius direction, to the outer diameter Φo of the glass tube 80.

(2) Production Method of Arc Tube

Figure 9A:
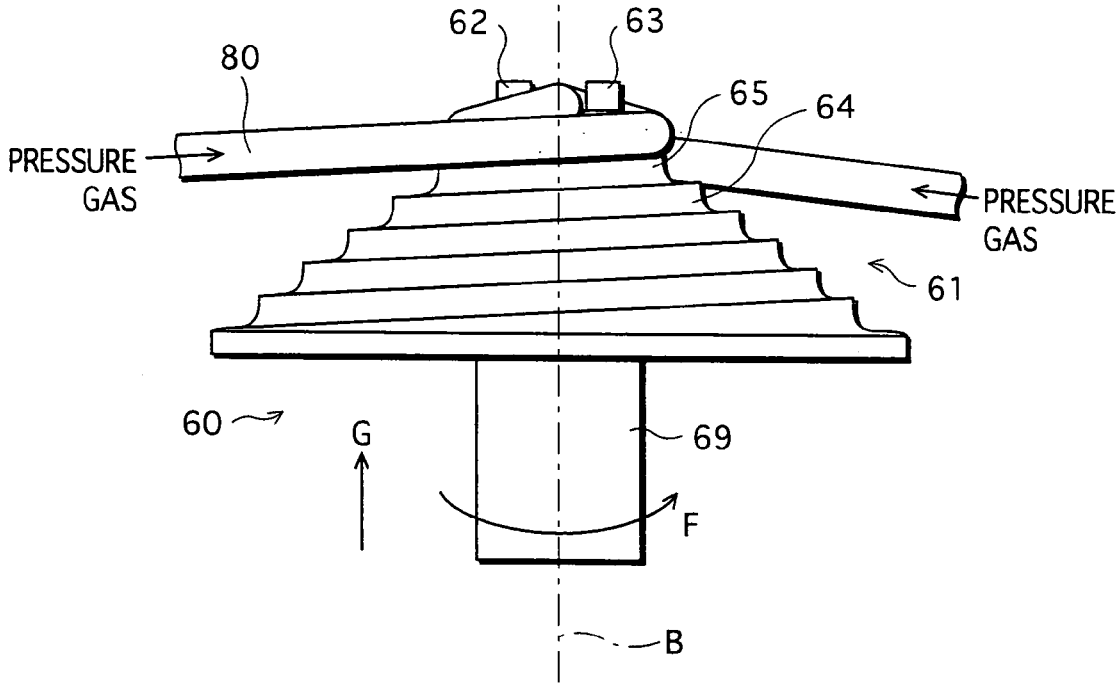
FIGS. 9A and 9B are respectively a diagram for explaining the production method of the arc-tube body.
Figure 9B:
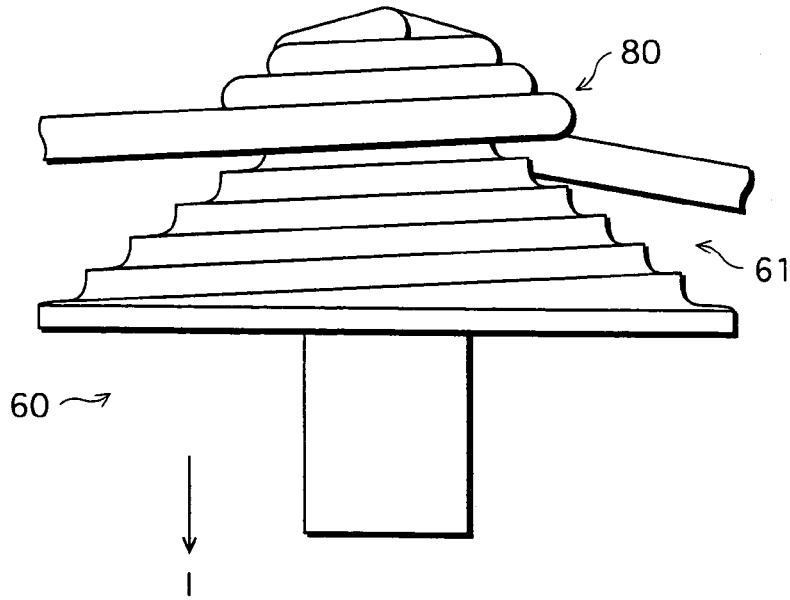

FIGS. 9A and 9B are respectively a diagram for explaining the production method of the arc-tube body.

First, the fixing part 69 of the mandrel 60 is mounted to a driving apparatus not shown in the drawing. Note that this driving apparatus has a function of driving the mandrel 60 to go along the direction G, as well as rotating the mandrel 60 with the axis B being an axis of rotation, into the direction F.

Next, a glass tube having straight-tube shape and having a circular cross section is prepared, and the middle part of this glass tube (including at least the part to be formed spiral) is heated to be softened in a heating furnace, or the like. The substantial center in the longitudinal direction of the softened glass tube 80 is then inserted between the latching parts 62 and 63 of the mandrel 60. Then as shown in FIG. 9A, while the both ends of the glass tube 80 are supported, the mandrel 60 is rotated with the axis B being the axis of rotation, and into the direction F, as well as being moved to the direction G.

By doing so, the substantial center of the glass tube 80 will be latched between the latching parts 62, and 63, and the parts of the glass tube 80 from the center part to the ends will be wound along the grooves 64, 65 formed on the circumference of the main body 61, and the glass tube 80 will be held by its circumferential surface being in contact with the grooves 64, 65. When in the held state, the grooves 64, 65 are in contact with the circumferential surface of the glass tube 80, at the position C of their contact range. This arrangement prevents the glass tube 80 from going out of the grooves 64, 65, at the time of winding.

Note that the amount by which the mandrel 60 moves into the direction G per turn, corresponds to one height-direction pitch of the grooves 64, 65 formed on the main body 61. While the glass tube 80 is being rotated, gas such as pressure-controlled nitrogen, argon, and the like, is blown into the glass tube 80, so that the glass tube 80 can maintain a circular cross section.

After the winding of the glass tube 80 on the mandrel 60 is finished, and when the glass tube 80 is hardened by lowering of its temperature, the glass tube 80 is detached from the mandrel 60, in the height direction.

More specifically, as FIG. 9B shows, while the glass tube 80 is held as it has been, the mandrel 60 is moved to the direction I. Or conversely, it is also possible to move the glass tube 80 to the direction G, while the mandrel 60 is held as it has been. Alternatively, both of the glass tube 80 and the mandrel 60 may be moved. However considering a case where another glass tube 80 is produced in succession, it becomes necessary to return the mandrel to an initial position before winding every time one glass tube 80 is produced. Therefore lowering the mandrel 60 is probably better in terms of production efficiency.

At this time, since the parts of the grooves 64, 65, which are positioned nearer to the top than the position C, are parallel to the axis B, the double-spiral glass tube 80 is easily removed from the mandrel 60 only by lowering the mandrel 60, even though being wound on the circumference of the main body 61.

Unnecessary end parts are cut away from the glass tube 80 removed from the mandrel 60, thereby completing the production of the arc-tube body 20. A phosphor is applied to the inner surface of the arc-tube body 20, then electrodes are sealed to the ends of the arc-tube body 20, and mercury and argon gas are enclosed inside, using a publicly-known technology. By this, the production of the arc tube 10 is complete.

Next, assembling the arc tube 10 produced in the above way, to the holder 50 is described.

First, the arc tube 10 and the holder 50 are prepared. Then the ends 24, 26 of the arc tube 10 are inserted into the insertion holes 55, 56 formed at the holding member 51 of the holder 50. Then adhesive, such as a silicone resin, is used to attach the ends 24, 26 to the inner surfaces of the insertion holes 55, 56. Here, the holder 50 used here is one in which the holding member 51 and the base-fixing member 58 have not yet been assembled together.

Next, the lead wires 32, 33 extending from the ends 24, 26 of the arc tube 10 are inserted to the power-source connection pins 57*a*, 57*b*, 57*c*, 57*d* of the base 57 fixed to the base-fixing member 58. At the same time, the base-fixing member 58 is fixed to the backside of the holding member 51, then the power-source connection pins 57*a* , 57*b* , 57*c* , and 57*d* are crimped. By this, the fluorescent lamp 1 is complete.

4. Others (1) Overlapping Part of Arc Tube

In the arc tube 10 of the above-described embodiment, the length Lc of the overlapping part 22*c* of adjacent glass tubes 22 in height direction is set as 16% of the outer diameter Φo of the glass tube 22. However this length is preferably in a range of 0% to 50%, inclusive. The reason is explained as follows.

When the length of the overlapping part becomes smaller than 0%, there will be a gap between two glass tubes adjacent in the height direction. The overall height of the arc tube will be accordingly large, and so it is hard to replace a circular fluorescent lamp.

On the contrary, when the size of the overlapping part becomes larger than 50%, the size of the arc tube in the height direction becomes small, which is preferable. However, there will be a problem that the distribution characteristics of luminous intensity deteriorates.

Figure 10:
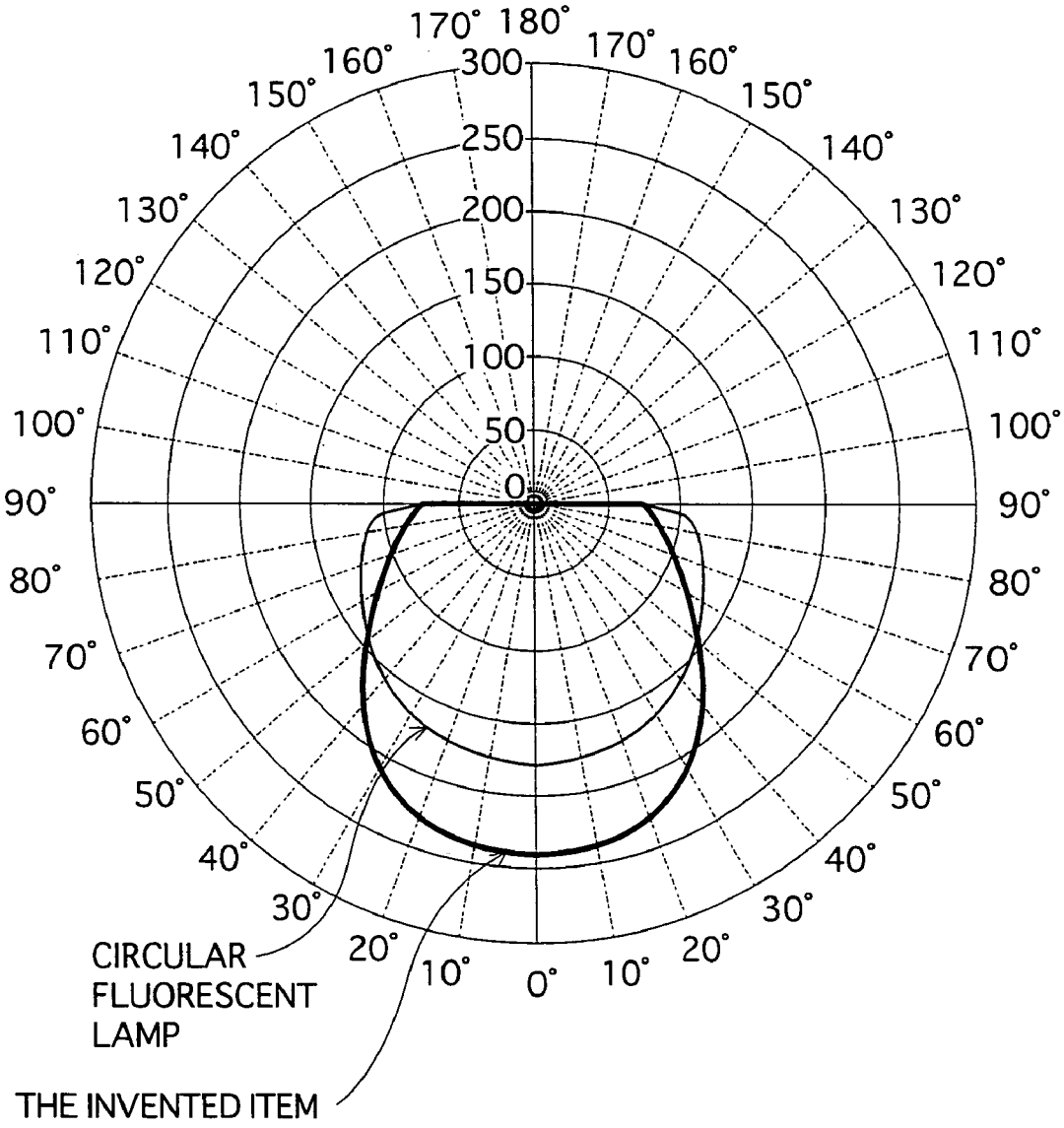
FIG. 10 is a diagram showing the distribution characteristics of luminous intensity for the embodiment's lamp and for the circular fluorescent lamp, both at the vertical cross section.

FIG. 10 is a diagram showing the distribution characteristics of luminous intensity for the embodiment's lamp and for the circular fluorescent lamp, both at the vertical cross section. Note that the fluorescent lamp 1 used in explaining the embodiment is expressed as "the invented item" in the drawing.

Compared to the circular fluorescent lamp, the invented item has weaker luminous intensity in the range of 90 to 50 degrees, but has stronger luminous intensity in the range of 0 to 50 degrees.

The reason why the invented item has weaker luminous intensity in the range of 90 to 50 degrees is that it has smaller outer diameter of the spiral configuration of the arc tube and also smaller tube's outer diameter of the glass tube, compared to the circular fluorescent lamp.

On the other hand, the reason why the invented item has stronger luminous intensity in the range of 0 to 50 degrees is that it has improved illuminance in the directly downward direction (direct-downward illuminance), because it has spiral shape that gradually broadens out in the radius direction, from the center part to the ends of the glass tube, thereby enabling light emission from the center part. On the contrary, the arc tube of the circular fluorescent lamp has a circular shape, and so no light is emitted from the center part thereof. In addition in the invented item, the outward appearance of the arc tube is a substantially circular-cone shape, when viewed from the side, and so the light emitted from the arc tube will not be obstructed, thereby improving the luminous intensity in the perspective direction.

As seen above, it is possible to improve the direct-downward illuminance as well as the illuminance around the directly downward direction, by making the arc tube have the double-spiral configuration that broadens out from the center part to the ends.

However if the length of the overlapping part becomes larger than 50%, then the light emitted from the arc tube will be obstructed/absorbed by the other glass tube that is adjacent in the height direction, thereby decreasing the illuminance around the directly downward direction, as well as causing significant illuminance difference between the directly downward direction and the vicinity thereof.

(2) Inner diameter of Glass Tube

The glass tube 22 used in the embodiment has an inner diameter Φi of 7.4 mm. However the inner diameter Φi may take other size if in the range of 6.5 mm to 9.5 mm inclusive.

This is because when the inner diameter Φi is in this range, the lamp efficiency will be high at the lamp lighting. The following describes the result of a lighting test performed using various test lamps whose inner diameter Φi of the glass tube, which constitutes the arc tube, is formed in a range of 5 mm to 15 mm.

Figure 11:
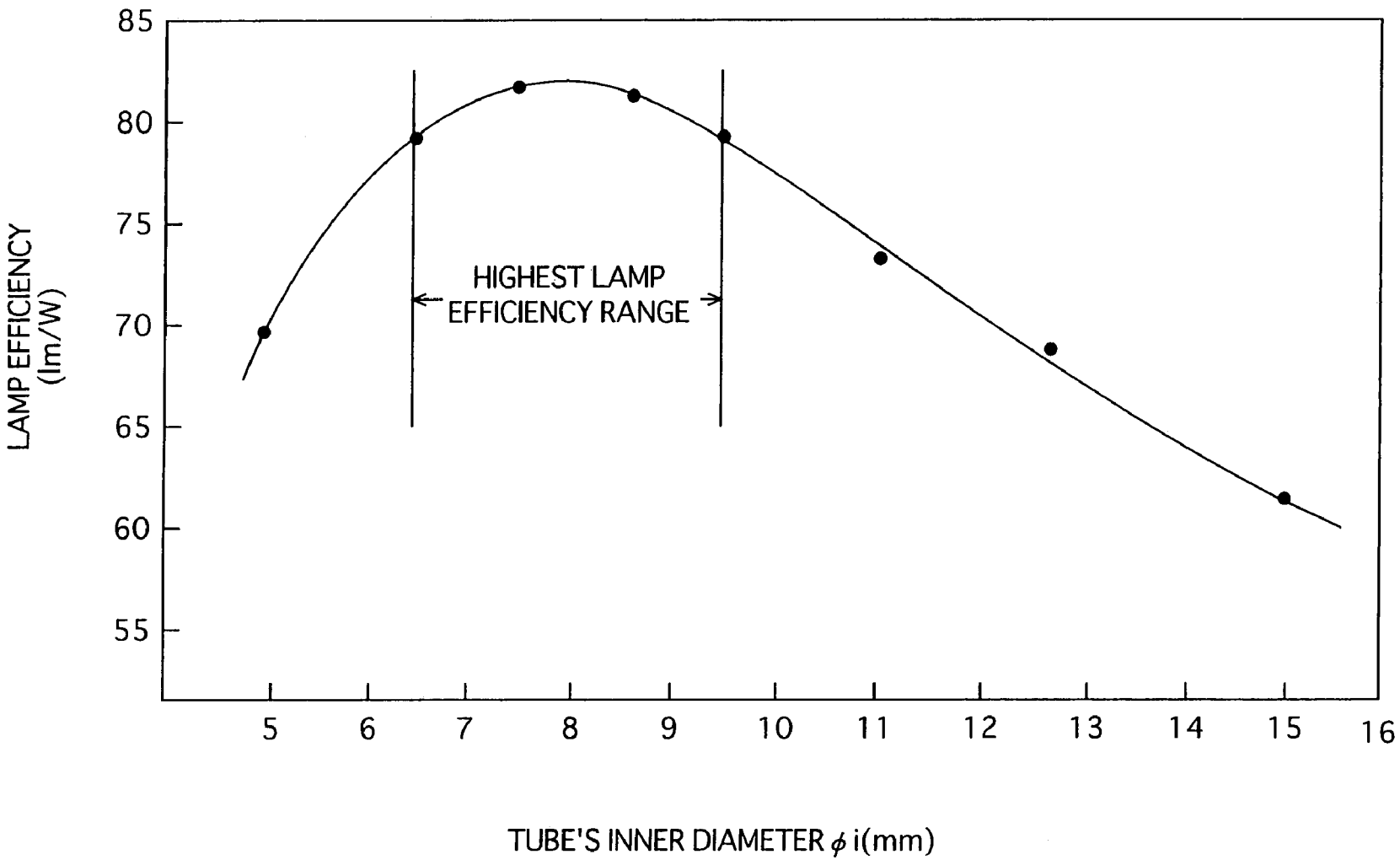
FIG. 11 is a diagram showing the relation between the inner diameter of a glass tube and lamp efficiency.

FIG. 11 is a diagram showing the relation between the inner diameter Φi of a glass tube and lamp efficiency, in a case where the bulb wall loading of its arc tube is set as 0.19 $W/cm^2$. As this drawing shows, the lamp shows a gradual highest lamp-efficiency area, when the glass tube's inner diameter Φi is in a range of 6.5 mm to 9.5 mm, with the highest lamp efficiency being 82 lm/W. Note that the bulb wall loading is obtained by dividing the lamp input by the inner surface area of the arc tube at between-electrode distance in the discharge path.

Here, the reason of setting the bulb wall loading of the arc tube as 0.19 $W/cm^2$ is as follows. That is, in general, the bulb wall loading for the fluorescent lamp usually used for the general housing illumination or the like is considered preferable to be set as 0.10 $W/cm^2$ or above, so as to obtain a compact external shape ( ). In addition, the above-mentioned bulb wall loading is also considered preferable to be set as 0.22 $W/cm^2$ or below, so as to assure the lamp rating life of 6,000 hours or longer.

On the other hand, a lamp, equipped with an arc tube whose inner diameter Φi of the glass tube is set as 6.5 mm to 9.5 mm, is used to perform the life test by means of an electronic ballast. The result shows that at least about 10,000 hours of rating life can be obtained.

Note that when the bulb wall loading for the arc tube is set in a range of 0.10 $W/cm^2$ to 0.22 $W/cm^2$ inclusive, it is confirmed that the lamp efficiency will be substantially the highest for the glass tube having inner diameter Φi of 6.5 mm to 9.5 mm, as well as confirmed the rating life time of 6,000 hours.

(3) Cross Sectional Shape of Grooves

The cross sectional shape of the grooves is not limited to as described in the embodiment. In the embodiment, the groove 164 is formed to have a cross section which is arc-shaped that corresponds to the circumferential shape of the glass tube, so that the groove 164 is contact with the circumferential surface of the glass tube 80 at the contact range whose ends are respectively the positions C and E. However the shape of the groove's cross section may take any shape as long as the groove can hold at least part of the glass tube, and that the groove is at least in contact with the glass tube at the positions C and E. In other words, the groove is not necessary in contact with the glass tube between the positions C and E.

Figure 12A:
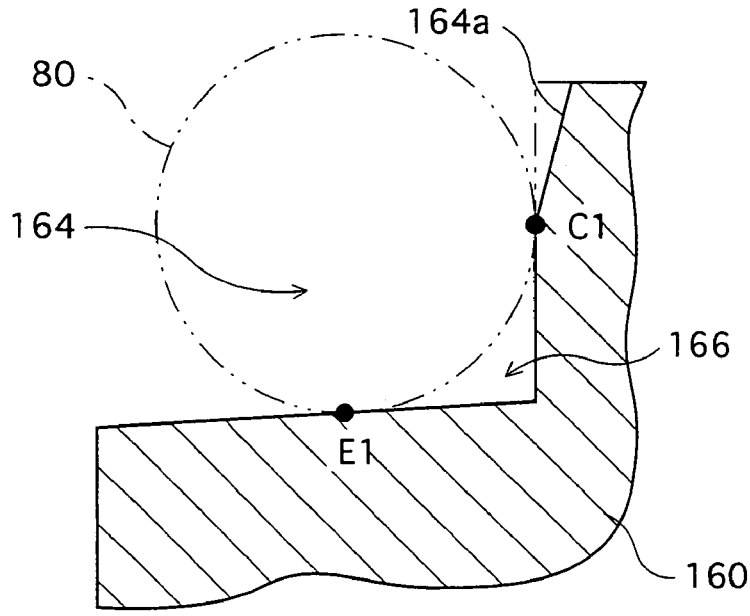
FIGS. 12A and 12B are respectively a diagram showing a modification example of the sectional shape of the grooves.
Figure 12B:
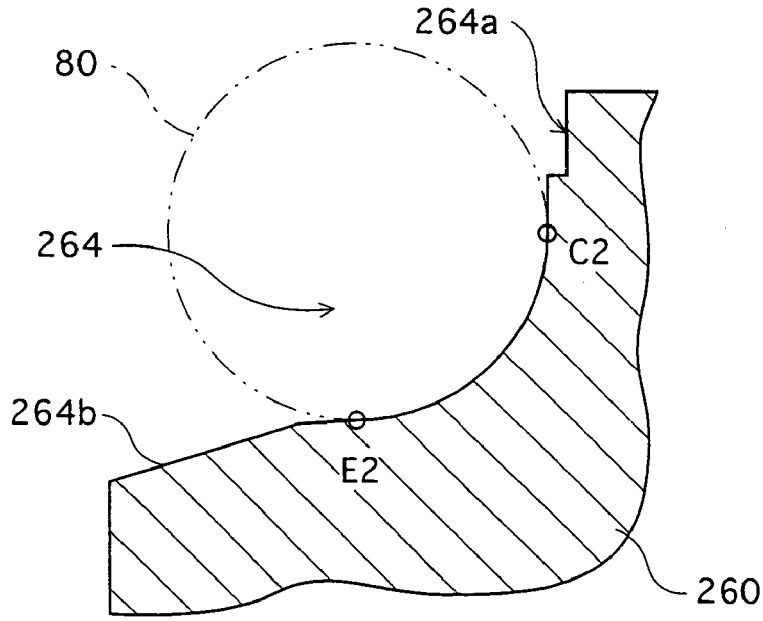

Each of FIGS. 12A and 12B shows a modification example of the cross sectional shape of the grooves.

In the first modification example shown in FIG. 12A, the groove 164's cross section is in contact with the glass tube at the position C1 and the position E1 with an opening 166 therebetween. and the planes that are respectively in contact with the positions C1 and E1 are substantially orthogonal to each other (in FIG. 12A the planes are illustrated as lines). Note that the position C1, E1 are the same position a as the positions C, E of die embodiment, respectively.

In. this modification example, a part 164*a* positioned upper side with respect to the position C1 (nearer to the apex of the main body), is inclined toward the axis of the main body 160. Note that this upper part 164*a* may also be parallel to the axis of the main body (illustrated as an imaginary line), just as the upper part 64*a* of the embodiment, which is positioned at an upper side with respect to the position C. Note that, for the grooves of this example, both of the height-direction pitch and the radius-direction pitch are the same as the counterparts in the embodiment.

In the second modification example shown in FIG 12B, the groove 264's cross section has such a shape that the positions C2 and E2 are the ends of the contact range, just as in the embodiment. However, in the second modification example, the part 264*a* , positioned upper side with respect to the position C2, is formed as a staircase that is stepped down towards the axis of the main body 260. Moreover, the part 264*b* , extending outside the contact range, is formed to be inclined downward.

Even with these structures, it is still easy to remove the glass tube from the mandrel only by separating the glass tube and the mandrel in the height direction, after the glass Tube wound on the mandrel has been hardened, just as in the embodiment.

(4) Shape of Arc Tube

The arc tube 10 in the above-described embodiment is formed as a double-spiral configuration, in which the glass tube 22 is wound around the spiral axis A, from the center part 28 to the ends 24. However, it is alternatively possible to form the arc tube 10 as a single-spiral configuration, in which only the center part to one of the ends of the glass tube is wound around the spiral axis. In this case, the number of groove provided at the circumferential surface of the mandrel, which is the characteristic part of the present invention, is one, so as to enable production of an arc tube smaller than conventional circular fluorescent lamps, as well as to simplify the structure of the production apparatuses.

In addition, the arc tube 10 of the embodiment is wound around the spiral axis A, from the center part 28 to the ends 24, 26. Howver, it is not necessary that the arc tube 10 is wound around the spiral axis up to the ends. An example of such a case is when the ends of the arc tube is bent towards the spiral axis. In production of such an arc tube, however, it is necessary to take the following process. That is, once the glass tube is formed spiral, the spirally-formed glass tube is removed from the mandrel. Then the parts corresponding to the ends of the arc tube are reheated to be softened, and then bent towards the spiral axis.

Furthermore, in the arc tube of the embodiment, both the pitch in height-direction of the glass tube (occasionally "pitch of glass tube portions") and the pitch in radius direction of the arc tube are constant. However, each of the pitches is not necessarily be constant, and may be different between the middle of the glass tube to its ends.

(5) Height-Direction Pitch of Grooves

In the mandrel of the embodiment, the height-direction pitch of each of the grooves 64, 65 is 0.83 time the outer diameter Φo of the glass tube 80. However, the pitch of the grooves may be other sizes, as long as staying within a rand of 0.5 time to 1.0 times, inclusive, the outer diameter of the glass tube.

If the height-direction pitch of the grooves becomes smaller than 0.5 time with respect to the outer diameter of the glass tube, the glass tube will be fallen off from the grooves while the glass tube is wound around the mandrel. Therefore, the mandrel should be in contact with the circumferential surface of the glass tube wound thereon, at the point nearest to the axis of the mandrel. So as to have the mandrel in contact with the glass tube at this point, it becomes necessary to have a height-direction pitch of the grooves to be 0.5 times, or greater than, the outer diameter of the glass tube.

On the contrary, if this height-direction pitch of the grooves becomes larger than 1.0 time the outer diameter of the glass tube, the arc-tube body formed by being wound, will have a gap between two glass tubes adjacent to each other in the height direction, and so the arc tube will have large height.

(6) Gap of Arc Tube

In the arc tube 10 of the embodiment described above, the gap 22*d* of two glass tubes 22 adjacent to each other in the radius direction has a length Gb of 1 mm. However this length may be smaller than 1 mm, or may be greater than 1 mm. In other words, the length of the gap 22*d* may be varied according to the circular fluorescent lamp to which the arc tube 10 is to be applied.

(7) Shape of Main Body of Mandrel and Shape of Arc Tube

The shape of the main body of the mandrel in the embodiment has a substantially circular-cone shape. Accordingly, the arc tube of the embodiment, formed using this mandrel, has an outward appearance of substantially circular-cone shape. However, the mandrel may take other shapes, so as to create the arc tube in different shape from that of the embodiment. For example, the mandrel may be created in shapes such as a polygonal-cone shape including a pyramid, and a cone shape whose bottom is oval-shaped.

Although the present invention has been fully described by way of example with references to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An arc tube comprising:

an arc-tube body made of a single glass tube that is wound around an axis from a middle part to both ends, to form a spiral broadening out from the middle part to each of the ends in the axial direction; and electrodes respectively sealed to the ends of the arc-tube body, wherein a gap exists between any two glass tube portions adjacent to each other in a direction orthogonal to the axis when the arc-tube body is viewed in the axial direction, and any two glass tube portions adjacent in the axial direction overlap with each other when the arc-tube body is viewed in the direction orthogonal to the axis, wherein the overlapping of any two glass tube portions, when the arc-tube body is viewed in the direction orthogonal to the axis, is smaller than 0.5 times an outer diameter of the glass tube.

2. The arc tube of claim 1, wherein an inner diameter of the glass tube is in a range of 6.5 mm to 9.5 mm, inclusive.

3. The arc tube of claim 2, wherein a bulb wall loading is set in a range of 0.10 W/cm$^{2\ l\ to}$ 0.22 W/cm$^2$, inclusive.

4. The arc tube of claim 1 further including mercury.

5. The arc tube of claim 4 further including a buffer gas.

6. The arc tube of claim 4 further including a ballast member operatively committed to the arc tube to activate the arc tube as a low-pressure mercury lamp.

7. The arc tube of claim 1 wherein the overlap of the glass tube portion of the spiral adjacent each other when viewed from a side direction orthogonal to the axis is within a range of greater than 0% to 50% or below of the outer diameter of the glass tube.

8. A low pressure arc tube comprising:

an arc-tube body made of a single elongated glass tube with respective ends that is wound around an axis from a middle part towards each of the respective ends to form a spiral broadening out from the middle part to each of the ends in the axial direction; and an electrode respectively sealed to each end of the arc-tube body, wherein a gap is positioned between any two adjacent glass tube portions in a radial direction orthogonal to the axis when the arc-tube body is viewed downward along the axial direction, and all glass tube portions adjacent to each other radially project outwardly, in a direction orthogonal to the axis, a continual source of light with no gaps as a result of adjacent glass tube portions overlapping with each other when viewed radially in a direction orthogonal to the axis wherein the overlapping tube portions and the arc tube body when viewed in the direction orthogonal to the axis, is smaller than 0.5 times an outer diameter of the glass tube.

9. The arc tube of claim 8, wherein an inner diameter of the glass tube is in a range of 6.5 mm to 9.5 mm, inclusive.

10. The arc tube of claim 9, wherein a bulb wall loading is set in a range of 0.10 $W/cm^2$ to 0.22 $W/cm^2$, inclusive.

11. The arc tube of claim 10 wherein the single glass tube is made substantially of strontium-barium silicate.

12. The arc tube of claim 11 wherein the single glass tube has an inner phosphor surface comprising a red, a blue and a green rare earth phosphor.

* * * * *